US009802812B2

(12) United States Patent
Larsson et al.

(10) Patent No.: US 9,802,812 B2
(45) **Date of Patent: *Oct. 31, 2017**

(54) KIT OF PARTS FOR A MODULE HAVING A NOZZLE BOOT AND A FUEL DISPENSING UNIT HAVING A NOZZLE MODULE ASSEMBLED WITH SUCH A KIT OF PARTS

(71) Applicant: Wayne Fueling Systems Sweden AB, Malmo (SE)

(72) Inventors: Bengt I. Larsson, Skivarp (SE); Hanna Helgesson, Dalby (SE); Kevin C. Burnett, Austin, TX (US); Scott R. Negley, III, Austin, TX (US); Neil Thomas, Austin, TX (US); Paul De La Port, Austin, TX (US); Annika Birkler, Malmo (SE)

(73) Assignee: Wayne Fueling Systems Sweden AB, Malmö (SE)

( * ) Notice: Subject to any disclaimer, the term of this patent is extended or adjusted under 35 U.S.C. 154(b) by 28 days.

This patent is subject to a terminal disclaimer.

(21) Appl. No.: 14/832,519

(22) Filed: Aug. 21, 2015

(65) Prior Publication Data

US 2015/0353341 A1 Dec. 10, 2015

Related U.S. Application Data

(63) Continuation of application No. 14/159,999, filed on Jan. 21, 2014, now Pat. No. 9,126,819, which is a (Continued)

(51) Int. Cl.
*B67D 7/12* (2010.01)
*B67D 7/84* (2010.01)

(Continued)

(52) U.S. Cl.
CPC ..... *B67D 7/84* (2013.01); *B67D 7/04* (2013.01); *B67D 7/06* (2013.01); *B67D 7/42* (2013.01)

(58) Field of Classification Search
CPC ... B67D 7/42; B67D 7/04; B67D 7/06; B67D 7/84

(Continued)

(56) References Cited

U.S. PATENT DOCUMENTS 1,955,712 A * 4/1934 Snow ..... B67D 7/16 222/75
2,150,025 A * 3/1939 Cook, Jr. ..... B67D 7/40 222/153.03

(Continued)

FOREIGN PATENT DOCUMENTS

CN 2055820 U 4/1990
CN 101045523 A 10/2007
NL 7811200 A 8/1979

OTHER PUBLICATIONS

International Search Report and Written Opinion for Application No. PCT/EP2009/063624, 8 pages, dated Aug. 2, 2010.

(Continued)

*Primary Examiner* — Benjamin R Shaw
(74) *Attorney, Agent, or Firm* — Lisa Adams

(57) ABSTRACT

This invention relates to a kit of parts that can include top plates, gable cover plates, gable structures each comprising a nozzle boot, side cover plates, and side structures each comprising a nozzle boot. The kit of parts is suitable for assembling a nozzle module according to any one of three configurations. The invention also relates to a fuel dispensing unit for refueling vehicles.

17 Claims, 4 Drawing Sheets

Related U.S. Application Data continuation of application No. 13/502,288, filed on Apr. 16, 2012, now Pat. No. 8,662,348.

(51) Int. Cl.
*B67D 7/04* (2010.01)
*B67D 7/06* (2010.01)
*B67D 7/42* (2010.01)

(58) Field of Classification Search
USPC ..... 222/173, 74, 75, 71, 72, 73, 530, 14; 141/311 R; 206/223, 229
See application file for complete search history.

(56) References Cited

U.S. PATENT DOCUMENTS 3,027,211 A * 3/1962 Wright ..... B67D 7/84 220/62.11
3,178,057 A * 4/1965 Nelson ..... B67D 7/38 222/35
3,342,537 A * 9/1967 Nelson ..... B67D 7/84 222/180
3,375,050 A * 3/1968 Sasnett, Jr. ..... B67D 7/84 312/100
4,186,850 A * 2/1980 Mahar ..... B67D 7/08 222/153.03
4,195,674 A * 4/1980 Madden ..... B67D 7/42 141/392
4,240,475 A * 12/1980 Schulz ..... B67D 7/32 141/392
4,611,729 A * 9/1986 Gerstenmaier ..... B67D 7/06 222/530
5,083,846 A * 1/1992 Day, Jr. ..... B67D 7/84 222/74
5,490,612 A * 2/1996 Coquerel ..... B67D 7/84 222/25
6,167,922 B1 * 1/2001 Seitz ..... B67D 7/84 141/86
6,328,060 B1 * 12/2001 Smith ..... B67D 7/40 137/355.2
7,975,878 B2 7/2011 Wemmert
8,662,348 B2 * 3/2014 Larsson ..... B67D 7/04 222/14
9,126,819 B2 * 9/2015 Larsson ..... B67D 7/04
2003/0205005 A1 * 11/2003 Paz ..... E04B 1/34315 52/79.1
2005/0144859 A1 * 7/2005 Paz ..... E04B 1/34315 52/79.1
2008/0006652 A1 * 1/2008 Wemmert ..... B67D 7/04 222/74
2010/0258587 A1 * 10/2010 Wheeler ..... B60S 1/50 222/2

OTHER PUBLICATIONS

Chinese Office Action for Application No. 200980162968.1, dated Apr. 25, 2013.

* cited by examiner

KIT OF PARTS FOR A MODULE HAVING A NOZZLE BOOT AND A FUEL DISPENSING UNIT HAVING A NOZZLE MODULE ASSEMBLED WITH SUCH A KIT OF PARTS

CROSS REFERENCE TO RELATED APPLICATIONS

This application is a continuation of U.S. application Ser. No. 14/159,999, filed on Jan. 21, 2014, and entitled "Kit of Parts for a Module Having a Nozzle Boot and a Fuel Dispensing Unit Having a Nozzle Module Assembled with Such a Kit of Parts," which is a continuation of U.S. application Ser. No. 13/502,288 (now U.S. Pat. No. 8,662,348), filed on Apr. 16, 2012, and entitled "Kit of Parts for a Module Having a Nozzle Boot and a Fuel Dispensing Unit Having a Nozzle Module Assembled with Such a Kit of Parts," which is a §371 of international EP2009/063624 filed on Oct. 16, 2009. These references are incorporated herein by reference in their entireties.

FIELD

The invention relates to a kit of parts suitable for use in connection with a fuel dispensing unit for refueling vehicles. The invention also relates to a fuel dispensing unit for refueling vehicles assembled with such a kit of parts.

BACKGROUND

A fuel dispensing unit used for filling the fuel tank of a motor vehicle with fuel is a complex device containing a vast number of components connected to each other. The components of a fuel dispensing unit can be divided into two categories, the inner components which are not visual to a user and the outer components surrounding the inner components. The inner components typically comprise hydraulics and a tube arrangement for dispensing fuel from an underground fuel reservoir together with electronic components controlling the fuel dispensing unit. The outer components represent the fundamental structure of the fuel dispensing unit protecting and supporting the so important inner components. In view of the above, the number of components in a conventional fuel dispensing unit is very high. Due to this vast number of components required in a fuel dispensing unit, the costs for production and assembling is a constant issue is this line of business.

Traditionally, there has been a great focus on the inner components in the development of fuel dispensing units, and thus also when addressing the problem of production and assembling costs. Accordingly, the development of the outer components of a fuel dispensing unit has not kept up with the one of the inner components. This fact is obvious from the prior art in this technical field.

Thus, a problem with the fuel dispensing units today is the costs for producing and assembling the high number of components, especially in regard of the so called outer components since the development of the same has kept a proportionately slow pace.

BRIEF DESCRIPTION

It is an object of the present invention to provide an improvement of the prior art. More particularly, it is an object of the present invention to decrease the number of components in a fuel dispensing unit and to simplify the assembling of the same.

These and other objects as well as advantages that will be apparent from the following description of the present invention are achieved by a kit of parts for assembling a nozzle module and a fuel dispensing unit having such a nozzle module according to the claims below.

Thus, a kit of parts is provided, comprising top plates, gable cover plates, gable structures each comprising a nozzle boot, side cover plates, and side structures each comprising a nozzle boot, which kit of parts is suitable for assembling a nozzle module having two opposing gable sections, two opposing side sections and a top section according to any one of following three configurations:

a) the top section is formed by one of said top plates (2); each of the two opposing gable sections is formed by one of said gable cover plates (3); at least one of the two opposing side sections is formed by one of said side structures (4) each comprising a nozzle boot (5), b) the top section is formed by one of said top plates (2); each of the two opposing gable sections is formed by one of said gable cover plates (3); and at least one of the two opposing side sections comprises at least one of said side structures (4) each comprising a nozzle boot (5), c) the top section is formed by one of said top plates; one of the two opposing gable sections is formed by one of said gable cover plates; the other of the two opposing gable sections is formed by one of said gable structures each comprising a nozzle boot; and each of the two opposing side sections is formed by one of said side cover plates.

This is advantageous in that a vast number of different nozzle modules for a fuel dispensing unit may be assembled by said kit of parts. Merely by replace one plate with another when assembling the nozzle module, the shape and user interface of the nozzle module may be varied. Since a small number of parts are used for several different types of nozzle modules, the overall number of components for a company manufacturing fuel dispensing units carrying the nozzle modules is reduced.

The two opposing gable sections of said nozzle module may be parallel and each extend in a tapering manner from a bottom section of said nozzle module to said top section, which is a suitable and aesthetically pleasing shape of the nozzle module.

The two opposing side sections may extend in a mutual converging manner from a bottom section of said nozzle module to said top section. The placement of the nozzle boot in an inclined section is advantageous in that the removal of the nozzle from said nozzle boot is facilitated.

The nozzle boot of each gable structure may be integrally formed therewith, which is advantageous in a manufacturing perspective due to the reduction of yet a component in the nozzle module and thus in the fuel dispensing unit.

The nozzle boot of each side structure may be integrally formed therewith, which is advantageous in a manufacturing perspective due to the reduction of yet a component in the nozzle module and thus in the fuel dispensing unit.

Each of said gable structure may further comprise a hose outlet in order to facilitate the extension of the hose and thereby make the fuel dispensing unit overall more user-friendly.

Each gable structure may be integrally formed therewith, which is advantageous in a manufacturing perspective due to the reduction of yet a component in the nozzle module and thus in the fuel dispensing unit.

The kit of parts may further comprise stiffening elements for stabilizing nozzle modules, each of said stiffening elements being assembled in a nozzle module in each one of said three configurations. This is advantageous in that the nozzle module is made more rigid and stable. Also, the stiffening element may be used for guiding possible fuel pipe means through the nozzle module. Accordingly, the stiffening elements may include a group of stiffening elements in which each stiffening element comprises a support structure adapted for supporting a tube arrangement extending through said nozzle module.

The top plates may include a group of top plates in which each top plate is provided at least one opening adapted to form a lead-through for a tube arrangement extending through said nozzle module. The nozzle module may with this structure be thread over the tube arrangement in an easy way during assembling of a fuel dispensing unit and thus enclose the tube arrangement in a way such that it is hidden and protected from the environment.

According to a second aspect of the present invention, the invention relates to a fuel dispensing unit comprising a nozzle module assembled with a kit of parts according to the above described features.

Generally, all terms used in the claims are to be interpreted according to their ordinary meaning in the technical field, unless explicitly defined otherwise herein. All references to "a/an/the [element, device, component, means, etc]" are to be interpreted openly as referring to at least one instance of said element, device, component, means, etc., unless explicitly stated otherwise.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION

Figure 1:
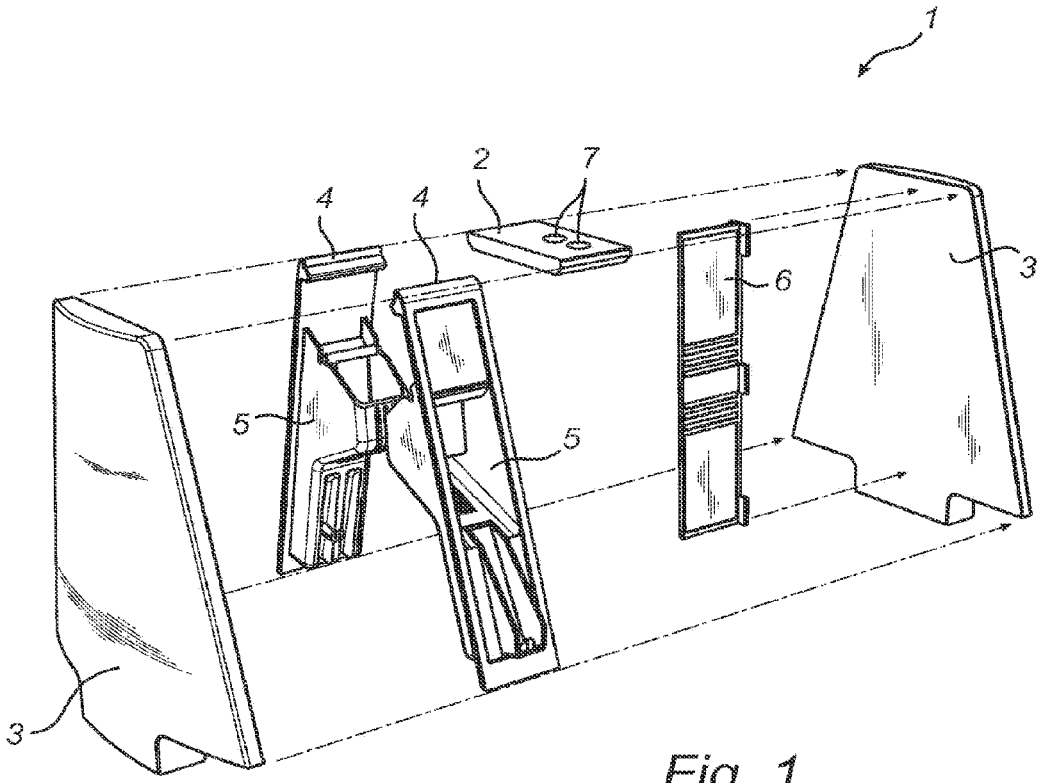
FIG. 1 is a perspective view of a kit of parts for assembling a nozzle module according to a first embodiment of the invention.

FIG. 1 illustrates a kit of parts 1 for assembling a nozzle module according to a first embodiment of the invention. The kit of parts 1 comprises a top plate 2, two gable cover plates 3, two side structures 4 each comprising a nozzle boot 5, and a stiffening element 6 for stabilizing the nozzle module. The top plate 2 is provided with openings 7 adapted to form a lead-through for a tube arrangement extending through the nozzle module.

Figure 2:
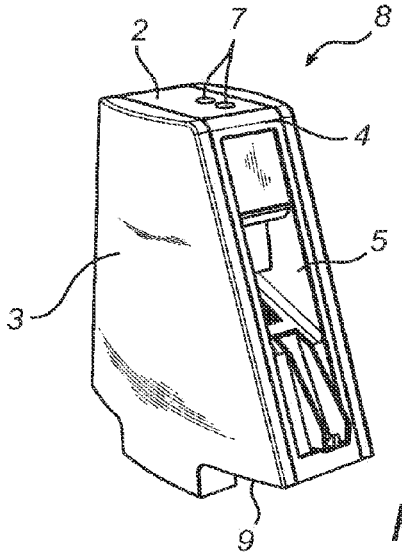
FIG. 2 is a perspective of a nozzle module assembled using the kit of parts shown in FIG. 1.

In FIG. 2 a nozzle module 8 is illustrated, which nozzle module 8 is assembled using the kit of parts 1 according to the first embodiment of the invention. The two opposing gable cover plates 3 are parallel and each extend in a tapering manner from a bottom section 9 of the nozzle module 8 to the top plate 2. The two opposing side structures 4 each comprising a nozzle boot 5 extend in a mutual converging manner from the bottom section 9 of the nozzle module 8 to the top plate 2. The two opposing gable cover plates 3 and the two opposing side structures 4 are all attached to the top plate 2. The nozzle boot 5 of each side structure 4 is integrally formed therewith. The nozzle module 8 may further comprise the stiffening element 6 (not shown) arranged in the interior of said nozzle module 8. It is understood that one of the side sections of the nozzle module may be blinded, i.e. the side section may be formed by a side cover plate.

Figure 3:
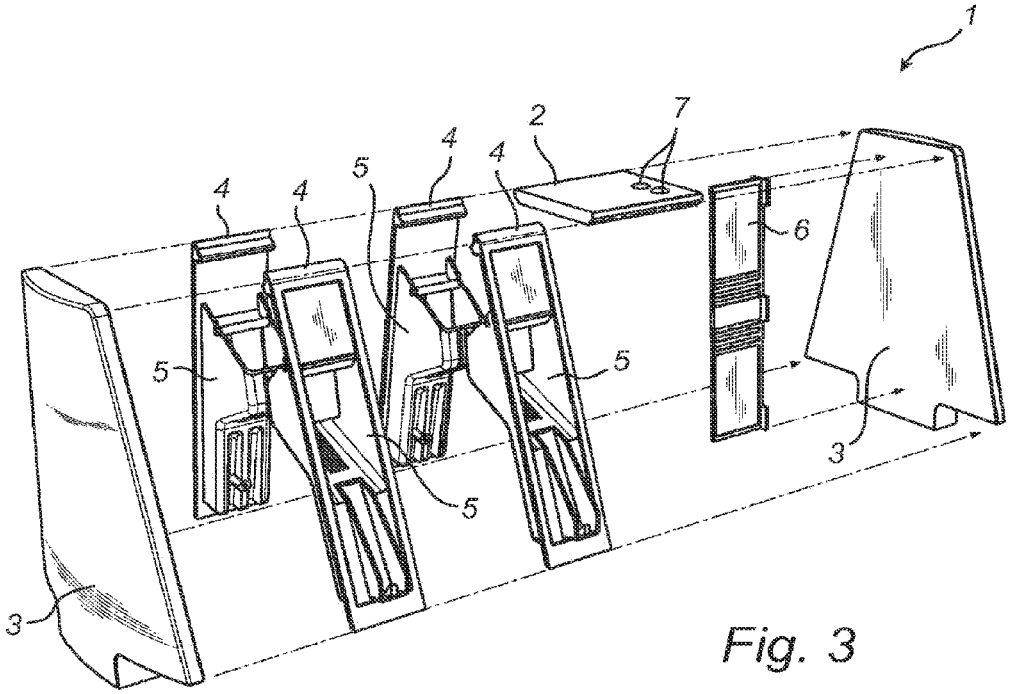
FIG. 3 is a perspective view of a kit of parts for assembling a nozzle module according to a second embodiment of the invention.

FIG. 3 illustrates the kit of parts 1 for assembling the nozzle module 8 according to a second embodiment of the invention. The kit of parts 1 comprises a top plate 2, two gable cover plates 3, four side structures 4 each comprising a nozzle boot 5, and a stiffening element 6 for stabilizing the nozzle module 8. The top plate 2 is provided with openings 7 adapted to form a lead-through for a tube arrangement extending through the nozzle module 8.

Figure 4:
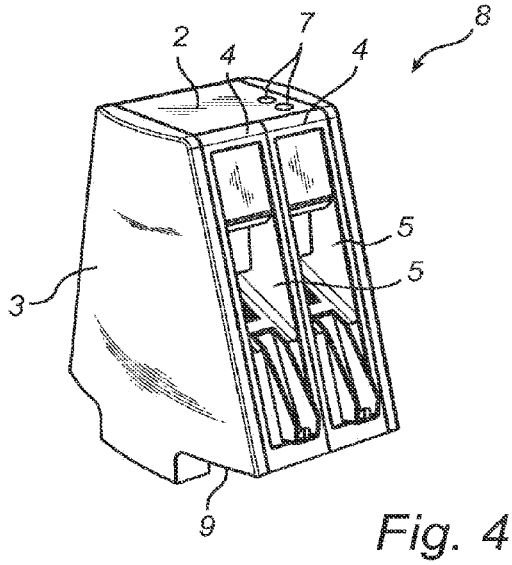
FIG. 4 is a perspective of a nozzle module assembled using the kit of parts shown in FIG. 3.

In FIG. 4 a nozzle module 8 is illustrated, which nozzle module 8 is assembled using the kit of parts 1 according to the second embodiment of the invention. The two opposing gable cover plates 3 are parallel and each extend in a tapering manner from a bottom section 9 of the nozzle module 8 to the top plate 2. The four side structures 4 each comprising a nozzle boot 5, which are assembled two on each side of the nozzle module 8, extend in a mutual converging manner from the bottom section 9 of the nozzle module 8 to the top plate 2. The two opposing gable cover plates 3 and the four side structures 4 are all attached to the top plate 2. The nozzle boot 5 of each side structure 4 is integrally formed therewith. The nozzle module 8 may further comprise the stiffening element 6 (not shown) arranged in the interior of said nozzle module 8. It is understood that one or both of the side sections of the nozzle module may be partly of fully blinded, i.e. each side section may comprise one or two side cover plates.

Figure 5:
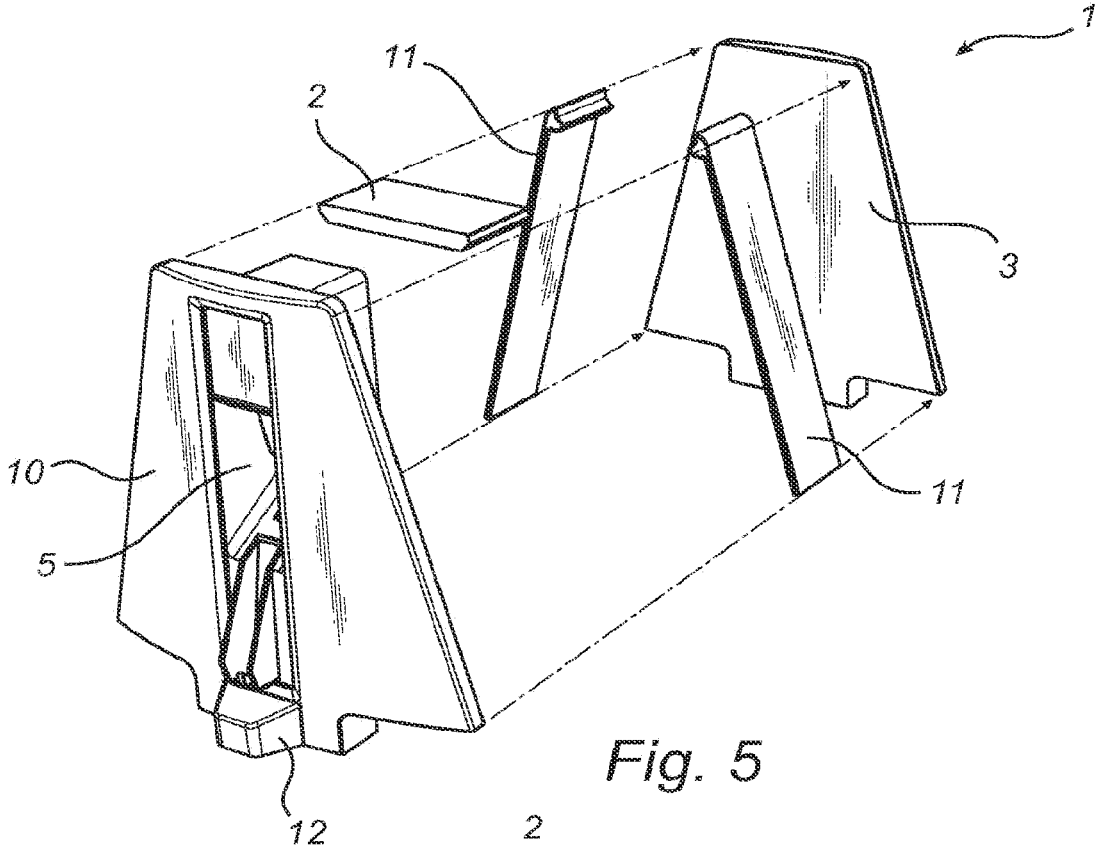
FIG. 5 is a perspective view of a kit of parts for assembling a nozzle module according to a third embodiment of the invention.

FIG. 5 illustrates a kit of parts 1 for assembling a nozzle module 8 according to a third embodiment of the invention. The kit of parts 1 comprises a top plate 2, a gable cover plate 3, a gable structure 10 comprising a nozzle boot 5, two opposing side cover plates 11, and a stiffening element 6 for stabilizing the nozzle module.

Figure 6:
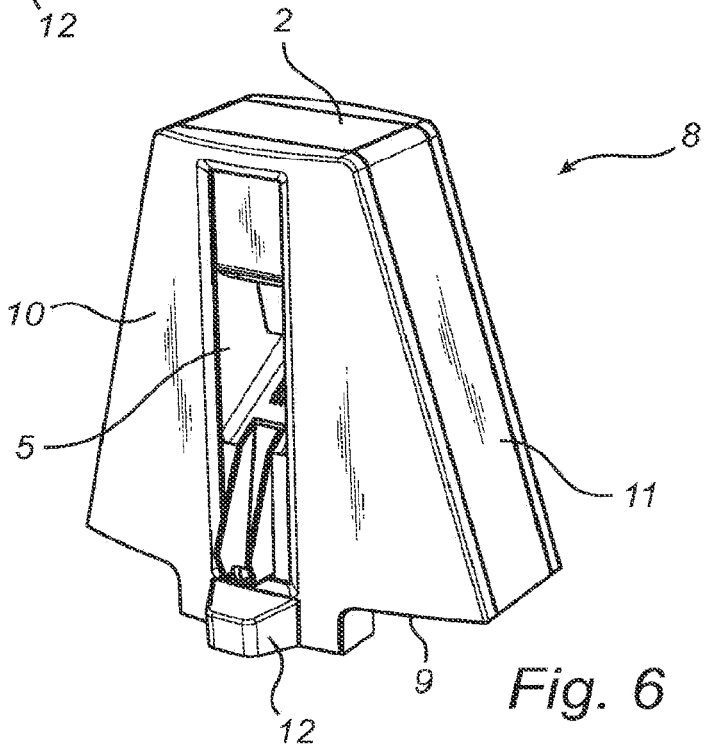
FIG. 6 is a perspective view of a nozzle module assembled using the kit of parts shown in FIG. 5.

In FIG. 6 a nozzle module 8 is illustrated, which nozzle module 8 is assembled using the kit of parts 1 according to the third embodiment of the invention. The gable cover plate 3 and the gable structure 10 comprising a nozzle boot 5 are parallel and each extend in a tapering manner from the bottom section 9 of the nozzle module 8 to the top plate 2. The two opposing side cover plates 11 each comprising a nozzle boot 5 extend in a mutual converging manner from the bottom section 9 of the nozzle module 8 to the top plate 2. The gable cover plate 3, the gable structure 10, and the two opposing side cover plates 11 are all attached to the top plate 2. The nozzle boot 5 of the gable structure 10 is integrally formed therewith. The gable structure 10 is provided with a hose outlet 12 integrally formed therewith. The nozzle module 8 may further comprise the stiffening element 6 (not shown) arranged in the interior of said nozzle module 8.

The inventive kit of parts may comprise components, i.e. gable cover plates 3, gable structures 10, side cover plates 11, side structures 4, top plates 2 and stiffening elements 6, in such number and variety that a nozzle module according to any of one of the three configurations described above may be assembled. Thus, the top plates 2 may comprise a group in which the top plates are closed and suitable for assembling a nozzle module 8 in accordance with the embodiment shown in FIG. 6. The top plates 2 may also comprise a group in which the top plates are provided with openings 7 adapted to form a lead-through for a tube arrangement and suitable for assembling a nozzle module 8 in accordance with the embodiments shown in FIG. 2 or 4. Further, the stiffening elements 6 may comprise a group in which the stiffening elements comprise a support structure adapted for supporting a tube arrangement extending through the nozzle module 8.

Figure 7:
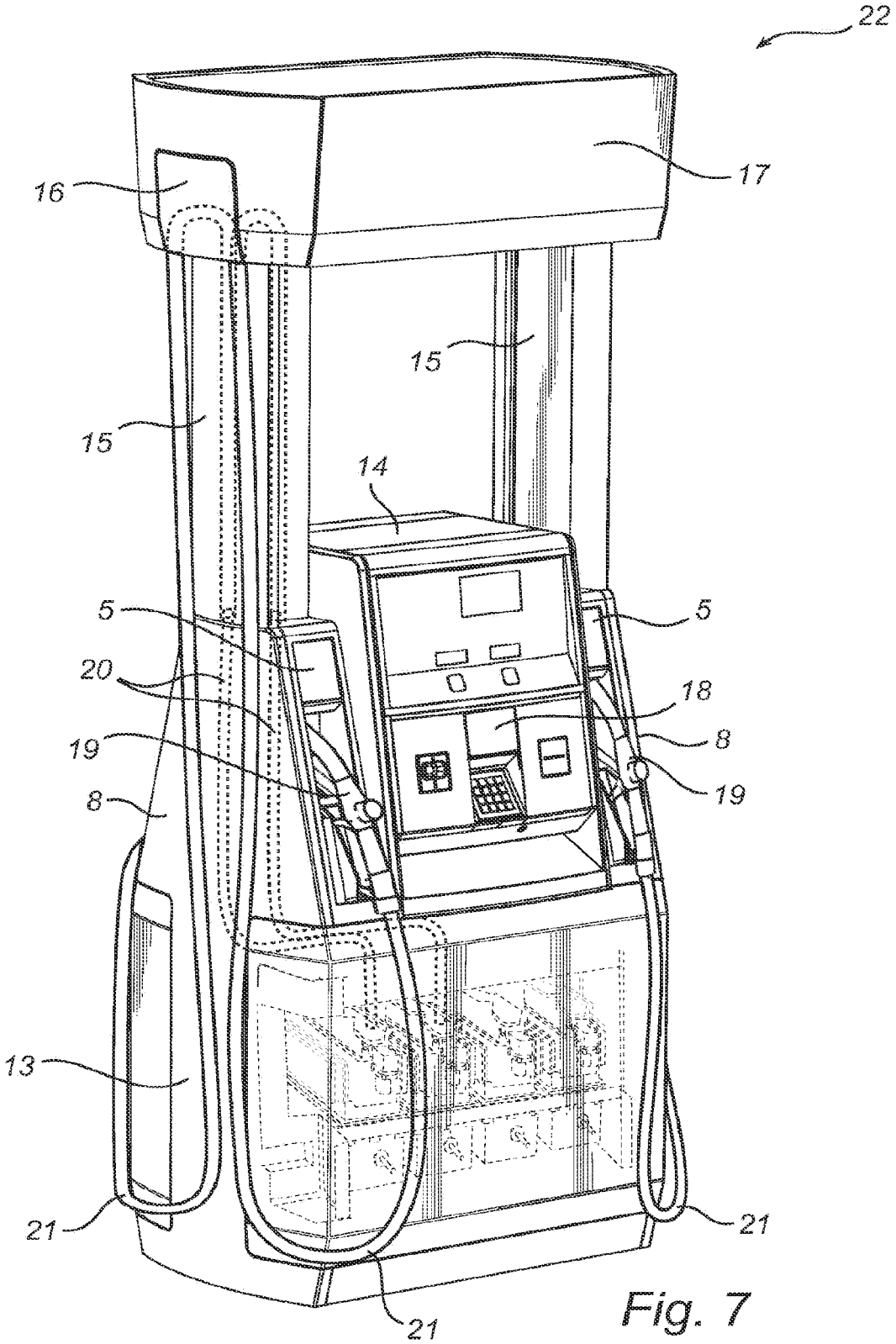
FIG. 7 is a perspective view of a nozzle module assembled using the kit of parts shown in FIG. 1, when assembled in a fuel dispensing unit.

FIG. 7 illustrates a fuel dispensing unit 22 having two nozzle modules 8, each one assembled using the kit of parts 1 according to the first embodiment of the invention. The fuel dispensing unit 22 comprises six different types of modules 13, 14, 8, 15, 16, 17. The modules 13, 14, 8, 15, 16, 17 are constituted by a base module 13, an electronics module 14, two nozzle modules 8, two column modules 15, a top module 16 and a display module 17.

The electronics module 14 is arranged above of the base module 13, the nozzle modules 8 are arranged above the base module 13, the column modules 15 are arranged above the nozzle modules 8 and the top module 16 is arranged above the column modules 17.

The arrangement of one module above or on top of another module results in joints between modules extending in a horizontal direction.

The base module 13 contains the hydraulics (not shown) of the fuel dispensing unit 22, such as fuel metering means, valves, pumps, vapour recovery system, etc. The exterior of the base module 13 comprises display surfaces for prints. The electronics module 14 contains means for controlling the fuel dispensing unit 22 and comprises a user interface 18 on one of its outer surfaces. The user interface 18 is adapted to show pump data and is equipped to handle payment of fuel after refueling. Each one of the nozzle modules 8 holds two nozzle boots 5, one on each side of the nozzle module 8, which nozzle boots 5 are intended to carry a nozzle 19, respectively. The column modules 15 are to be arranged above or on top of the nozzle module 8 in order to elevate and support the top module 16 when assembled. The top module 16 itself comprises display surfaces for prints. However the top module 16 is also adapted to receive a display module 17, which in turn comprises display surfaces for prints.

When assembling the fuel dispensing unit 22, the base module 13 is positioned on the ground in a suitable location for the fuel dispensing unit 22. The electronics module 14 is arranged on top of the base module 13, whereby the user interface 18 will be located in a suitable height for a user of the fuel dispensing unit 22. A through opening is provided in the electronics module 14 separating said user interface 18 from said base module 13. Two nozzle modules 8 are arranged on top of the base module 13, one on each side of the electronics module 14. Each nozzle module 8 carries two nozzle boots 5 located opposite to each other and adapted to receive a nozzle 19, respectively. A column module 15 is arranged on top of each one of the nozzle modules 8. The two column modules 15 in turn carry a top module 16, which is arranged on top of the two column modules 15. A display module 17 is arranged at the top module 16, which display module 17 partly surrounds the top module 16. The display module 17 comprises display surfaces for prints.

The fuel dispensing unit 22 has a tube arrangement 20 and a hose 21 connected thereto for transporting fuel from an underground fuel reservoir (not shown) to the nozzle 19. The tube arrangement 20 extends from the underground fuel reservoir to and through the nozzle module 8. Above the nozzle module 8, the tube arrangement 20 is connected to the hoses 21 belonging to that particular side of the fuel dispensing unit 22. The same connection between the tube arrangement 20 and the hoses 21 is made in the nozzle module 8 located on the other side of the fuel dispensing unit 22. The hoses 21 then in turn extend from the nozzle module 8 to a respective nozzle 19 via the column module 15 and the top module 16. This way, the tube arrangement 20 is enclosed by the base module 13, the nozzle module 8, and the hoses 21 are partly enclosed by the column module 15 and the top module 16. The tube arrangement 20 may, however, extend from said base module 13 to the column module 15 and be connected to the hoses 21 in the column module 15. The hoses 21 then extend from the column module 15 to the nozzles 19 via the top module 16. Another possibility is for the tube arrangement 20 to extend from the base module 13 all the way to the top module 16. With this solution the hoses 21 then extend directly from the top module 16 to the nozzles 19.

Each stiffening element 6 may comprise a support structure adapted for supporting the tube arrangement 20 extending through the nozzle module 8.

The nozzle module 8 may also be adapted to contain electronic cables which for example are to extend between different parts of the electronics module 14.

According to a second aspect of the invention a fuel dispensing unit is provided comprising a nozzle module assembled with a kit of parts according to the above described features.

The invention has mainly been described above with reference to a few embodiments. However, as is readily appreciated by a person skilled in the art, other embodiments than the ones disclosed above are equally possible within the scope of the inventions, as defined by the appended claims.

What is claimed is:

1. A method of assembling a nozzle module of a fuel dispensing unit, comprising:

selecting a top component from a plurality of top components that comprise a first top plate and a second top plate, the second top plate being greater in size than the first top plate;

selecting a first end component from a plurality of end components that comprise at least one gable cover plate and at least one gable structure having a nozzle boot therein configured to seat a fuel dispensing nozzle;

selecting a second end component from the plurality of end components;

selecting at least two side components from a plurality of side structures, the plurality of side structures comprise at least one side cover plate and at least one side structure having a nozzle boot therein configured to seat a fuel dispensing nozzle; and assembling the selected components to mate the top component to the first and second end components and to the at least two side components to form a nozzle module for use in a fuel dispensing unit.

2. The method of claim 1, wherein the selected top component comprises the first top plate.

3. The method of claim 1, wherein the selected top component comprises the second top plate.

4. The method of claim 1, wherein the selected first end component comprises a first one of the at least one gable cover plate and a second one of the at least one gable cover plate.

5. The method of claim 1, wherein the selected first end component comprises a first one of the at least one gable cover plate and a first one of the at least one gable structure.

6. The method of claim 1, wherein the selected at least two side components comprises a first one of the at least one side cover plate and a second one of the at least one side cover plate.

7. The method of claim 1, wherein the selected at least two side components comprises a first one of the at least one side cover plate and a first one of the at least one side structure.

8. The method of claim 1, wherein the selected at least two side components comprises first, second, third, and fourth side components.

9. The method of claim 1, further comprising assembling a second module for use in a fuel dispensing unit by mating one of the plurality of top components to a third end component selected from the plurality of end components, a fourth end component selected from the plurality of end components, and at least two side components selected from the plurality of side structures.

10. The method of claim 1, further comprising a stiffening element, and wherein assembling the selected components further comprises assembling the stiffening element to the nozzle module.

11. The method of claim 1, further comprising coupling the nozzle module to a fuel dispensing unit such that the nozzle module is positioned on top of a base unit and is positioned adjacent to an electronics module.

12. A method of assembling a nozzle module of a fuel dispensing unit, comprising:

providing a kit of parts comprising at least one gable cover plate, at least one gable structure comprising a nozzle boot, at least one side cover plate, at least one side structure comprising a nozzle boot, and at least one top plate;

assembling selected components from the kit of parts to form a first nozzle module of the fuel dispensing unit having one of the top plates mated at a first edge to a first one of the at least one side cover plate and the at least one side structure, mated at a second edge opposite to the first edge to a second one of the at least one side cover plate and the at least one side structure, mated at a third edge to a first one of the at least one gable cover plate and the at least one gable structure, and mated at a fourth edge opposite to the third edge to a second one of the at least one gable cover plate and the at least one gable structure.

13. The method of claim 12, wherein the top plate is further mated at the first edge to a third one of the at least one side cover plate and the at least one side structure, and is mated at the second edge to a fourth one of the at least one side cover plate and the at least one side structure.

14. The method of claim 12, further comprising assembling selected components from the kit of parts to form a second nozzle module.

15. The method of claim 14, wherein the second nozzle module has a configuration that differs from a configuration of the first nozzle module.

16. The method of claim 12, wherein the kit of parts further comprises a stiffening element and assembling selected components from the kit of parts further comprises assembling the stiffening element to the first nozzle module.

17. The method of claim 13, further comprising coupling the first nozzle module to a fuel dispensing unit such that the first nozzle module is positioned adjacent to an electronics module.

* * * * *